US010676864B2

(12) United States Patent
Wenzel et al.

(10) Patent No.: US 10,676,864 B2
(45) Date of Patent: Jun. 9, 2020

(54) STRANDING UNIT FOR A STRANDING MACHINE AND BASKET FOR A STRANDING UNIT

(71) Applicant: LEONI KABEL GMBH, Nuremberg (DE)

(72) Inventors: Joerg Wenzel, Roth (DE); Daniel Deyerler, Spalt (DE)

(73) Assignee: LEONI Kabel GmbH, Nuremberg (DE)

( * ) Notice: Subject to any disclaimer, the term of this patent is extended or adjusted under 35 U.S.C. 154(b) by 208 days.

(21) Appl. No.: 15/837,416

(22) Filed: Dec. 11, 2017

(65) Prior Publication Data

US 2018/0320312 A1 Nov. 8, 2018

Related U.S. Application Data

(63) Continuation of application No. PCT/EP2016/063056, filed on Jun. 8, 2016.

(30) Foreign Application Priority Data

Jun. 9, 2015 (DE) ..... 10 2015 210 572

(51) Int. Cl.
*D07B 3/06* (2006.01)
*D07B 7/04* (2006.01)
*D07B 7/06* (2006.01)

(52) U.S. Cl.
CPC ..... *D07B 3/06* (2013.01); *D07B 7/04* (2013.01); *D07B 7/06* (2013.01); *D07B 2207/4004* (2013.01); *D07B 2401/406* (2013.01)

(58) Field of Classification Search
CPC ..... D07B 3/06; D07B 7/04; D07B 7/06
See application file for complete search history.

(56) References Cited

U.S. PATENT DOCUMENTS 1,752,115 A * 3/1930 Sliter ..... D07B 1/0693 57/59
1,866,272 A * 7/1932 Seeley ..... D07B 3/02 57/58.52

(Continued)

FOREIGN PATENT DOCUMENTS

DE 1004974 3/1957
DE 1510106 A1 3/1970

(Continued)

OTHER PUBLICATIONS

Anonymous, "High speed tubular stranders & closers for the wire rope and cable industries", Internet Article, (Sep. 6, 2012), URL: http://web.archive.org/web/20120906020922/http://www.hansonedwards.co.uk/technical_library_docs/hanson_high_speed.pdf, (Aug. 8, 2016), XP055294172 [Y] 3 * the whole document *.

*Primary Examiner* — Shaun R Hurley
(74) *Attorney, Agent, or Firm* — Laurence A. Greenberg; Werner H. Stemer; Ralph E. Locher

(57) ABSTRACT

A stranding unit for a stranding machine has a stranding axis and a cage in which a number of baskets are arranged for receiving a number of reels having a strand material wound thereon. The stranding unit is characterized in that a stand is arranged which has a frame which extends around the cage in a circumferential direction around the stranding axis. The cage is mounted on the frame by a number of frame bearing elements and is rotatable around the stranding axis. As a result of the circumferential bearing, centrifugal forces are particularly efficiently distributed and absorbed by the frame during operation. In an advantageous further development, a plurality of basket are also mounted in a similar manner within the frame. The stranding unit as a whole is furthermore constructed such that it can be operated at a particularly high rotational speed.

18 Claims, 8 Drawing Sheets

(56) References Cited

U.S. PATENT DOCUMENTS

| | | | | | |
|---|---|---|---|---|---|
| 2,147,065 | A | | 2/1939 | Somerville | |
| 2,218,278 | A | | 10/1940 | Burrows | |
| 2,976,669 | A | * | 3/1961 | Petersen | D07B 3/06 57/64 |
| 3,130,754 | A | * | 4/1964 | Bratz | F16C 1/26 138/133 |
| 3,234,721 | A | * | 2/1966 | Carter | B65H 81/08 57/13 |
| 3,448,569 | A | * | 6/1969 | Rose | D07B 3/06 57/15 |
| 3,872,660 | A | * | 3/1975 | Gallagher-Daggitt | D07B 1/22 57/58.3 |
| 3,955,348 | A | * | 5/1976 | Orlandi | D07B 3/02 57/13 |
| 4,253,298 | A | * | 3/1981 | Varga | B65H 49/02 57/13 |
| 4,519,197 | A | * | 5/1985 | Borroni | B65H 49/34 57/64 |
| 4,640,087 | A | | 2/1987 | Targa et al. | |
| 5,144,792 | A | | 9/1992 | Lange et al. | |
| 5,263,309 | A | * | 11/1993 | Campbell | D07B 3/06 57/13 |
| 5,282,353 | A | * | 2/1994 | Kellstrom, Jr. | D07B 7/04 476/36 |
| 5,390,481 | A | * | 2/1995 | Langner | B21C 47/003 57/314 |
| 5,983,617 | A | * | 11/1999 | Nelson | G02B 6/449 242/439.5 |

FOREIGN PATENT DOCUMENTS

| | | | |
|---|---|---|---|
| DE | 2115249 | A1 | 10/1972 |
| DE | 19847958 | A1 | 5/2000 |
| EP | 0407855 | A2 | 1/1991 |
| JP | S374371 | | 1/1959 |
| JP | S459134 | B | 4/1970 |
| JP | S4931933 | A1 | 3/1974 |
| JP | S558601 | U1 | 1/1980 |
| JP | S6099085 | A | 6/1985 |
| JP | S6189392 | A | 5/1986 |

* cited by examiner

STRANDING UNIT FOR A STRANDING MACHINE AND BASKET FOR A STRANDING UNIT

CROSS-REFERENCE TO RELATED APPLICATION

This application is a continuation, under 35 U.S.C. § 120, of copending international application No. PCT/EP2016/063056, filed Jun. 8, 2016, which designated the United States; this application also claims the priority, under 35 U.S.C. § 119, of German patent application No. DE 10 2015 210 572.5, filed Jun. 9, 2015; the prior applications are herewith incorporated by reference in their entirety.

BACKGROUND OF THE INVENTION

Field of the Invention

The invention relates to a stranding unit for a stranding machine, having a stranding axis and having a cage in which at least one basket is arranged for receiving a reel having strand material wound thereon. The invention furthermore relates to a basket of a stranding unit.

A corresponding stranding machine is also known as a basket stranding machine, exemplary embodiments are described in published, European patent application EP 0 407 855 A1 (corresponding to U.S. Pat. No. 5,144,792) and German patent DE 2 115 249.

In stranding, a plurality of strands is conventionally stranded together by a stranding machine, for example to form a cable or rope. This typically involves twisting the strands together around a stranding axis as they are conveyed simultaneously in the direction of the stranding axis, i.e. in a stranding or production direction along the stranding axis or running towards this. The strands are provided by a stranding unit, which has a number of reels onto which the strands are wound as strand material. Each reel is conventionally inserted into a basket which has a so-called yoke for holding the reel. During the unreeling, the basket is typically additionally moved on a circular path around the stranding axis to achieve the required twisting movement. Two rotational movements are therefore generated: on the one hand, a rotation of the reel around a reel axis for unwinding the strand material and, on the other, a rotation of the reel on a circular path around the stranding axis.

A plurality of baskets is furthermore regularly combined in a cage, which is also known as a drum, and arranged distributed around the stranding axis in a circumferential direction. The individually unreeled strands are finally brought together at a stranding nipple which is connected downstream of the stranding unit in the stranding direction. Sometimes an unwinder is additionally connected upstream of the stranding unit, which provides a center core which is supplied to the stranding nipple through the stranding unit and around which the individual strands are stranded. Depending on the embodiment, it is also possible to arrange a plurality of stranding units and stranding nipples in succession in the stranding direction, wherein the stranded material generated at a stranding nipple is supplied to a successive stranding unit as a center core.

In stranding machines, the production speed in length over time is substantially restricted owing to the forces which arise during the diverse rotational movements. Owing to the occasionally high weight of the strand material on the reels and the circular movement of the baskets, high centrifugal forces are, amongst other things, produced in the radial direction with respect to the stranding axis during operation. Also, the strands which are conveyed out of the stranding unit and to the stranding nipple are subjected to corresponding centrifugal forces. The rotational movement furthermore results in high loads on the baskets and the yokes, in particular at high rotational speeds, with the risk of deformation or damage.

Published, European patent application EP 0 407 855 A2 for example describes a basket stranding machine having a supporting tube which extends along the stranding axis and on which a plurality of supporting shields are arranged for holding reel carriers. To increase the operating speed, it is proposed to connect the supporting shields to one another in a fixed manner via longitudinal webs and to thus increase the rigidity of the arrangement as a whole. Such a stranding machine can then be operated at higher rotational speeds.

German patent DE 2 115 349 describes a basket stranding machine in which the rotational axes of the reels, i.e. the reel axes, are aligned parallel to the stranding axis. Through a division into a plurality of reel fields of only two reels each, the rotation circle of the baskets is furthermore kept as small as possible. The centrifugal forces which arise are thus lower and a corresponding increase in the rotational speed, and therefore the production speed, is possible.

SUMMARY OF THE INVENTION

Against this background, it is the object of the invention to provide an improved stranding unit for a stranding machine. The stranding unit should be operable at as high a rotational speed as possible during stranding and should have as high a production speed as possible during the production of stranded material. The aim is furthermore to provide a correspondingly suitable basket for a stranding unit.

The object is achieved according to the invention by a stranding unit for a stranding machine having the features according to the main claim. Advantageous designs, further developments and variants are the subject matter of the sub claims. The object is furthermore achieved by a basket having the features according to main basket claim. The explanations relating to the stranding unit also apply analogously to the basket and vice versa.

The stranding unit is configured for use in a stranding machine and has a stranding axis, which is in particular also a stranding axis of the stranding machine and along which the production of stranded material takes place. The stranding unit has a cage in which at least one basket, preferably a plurality of baskets is arranged for each receiving a reel having strand material wound thereon. During operation, this strand material is unreeled from the reels and stranded into stranded material by the stranding machine. According to the invention, the stranding unit has a stand having a frame which is formed to extend in particular completely around the cage in a circumferential direction around the stranding axis, wherein the cage is mounted on the frame by a number of frame bearing elements and is rotatable around the stranding axis. In other words: the cage is rotatably mounted on the frame, and preferably mounted only on the frame, wherein an additional shaft in the direction of the stranding axis is, in particular, omitted. The cage here is connected to the stand in a securing manner and, during operation, the cage rotates around the stranding axis in the frame.

Essential advantages of the invention consist in particular in that centrifugal forces which arise during operation are absorbed and distributed in an improved manner and the risk of deformations of individual components of the stranding unit during operation are prevented or at least reduced. This is achieved in particular in that the bearing of the cage does not take place in a conventional manner with a central shaft, but is shifted from the center and to the circumference of the cage. As a result of the advantageously fully circumferential design of the frame, it absorbs centrifugal forces directed in all directions perpendicularly to the stranding axis in an optimal manner during operation. The baskets here are advantageously arranged in the cage such that they are arranged at approximately the same longitudinal position as the frame bearing elements in the direction of the stranding axis. The centrifugal forces which arise during the rotation of the cage and the baskets are then transmitted to the frame in a particularly optimal manner, directly in the radial direction, i.e. perpendicularly to the stranding axis, via the frame bearing elements. A further advantage of the invention then consists in particular in that the frame, owing to its arrangement outside the cage, can be configured to be virtually as solid as possible and therefore in a particularly stable manner and is also expediently formed accordingly for absorbing particularly high forces. For example, the frame is formed by a number of steel rings extending around the stranding axis, which are furthermore fastened to the stand. The frame then surrounds the cage completely and, in particular, also the baskets arranged therein. All in all, this therefore constitutes a departure from conventional concepts for driving the cage and the baskets and for arranging the baskets.

Owing to the above-described outer and circumferential bearing of the cage, the shaft of the stranding unit, which is otherwise arranged in the center and extends along the stranding axis, can be dimensioned to be considerably smaller. It is therefore preferable to use a shaft having a diameter which is reduced considerably over that of conventional shafts. It is preferably even possible to dispense with a shaft completely and the stranding unit then has a drive motor which drives the cage and is arranged outside the frame, in particularly to the side of it. This results in more free space in the center of the cage so that the baskets can be, and also expediently are, arranged closer to the stranding axis compared to conventional stranding units, thereby reducing the radius of the rotation circle of the baskets during operation. The centrifugal forces during operation of the stranding unit are thus in turn reduced so that a higher rotational speed and therefore a higher production speed are possible in an advantageous manner.

During operation of the stranding unit, the stand and the frame connected thereto are fixed and unmovable and form a receiving device for the moving parts of the stranding unit. The cage is mounted in the frame and is rotated around the stranding axis during operation in order to realize the necessary twisting movement of the strand material for stranding. The baskets here are connected to the cage such that, during a rotation of the cage, the baskets are moved around the stranding axis on one or more rotation circles. The stranding axis moreover extends in a stranding or production direction in which the strand material is conveyed and the production of the stranded material from the strand material takes place in general. The stranding unit then has a front side, which is located downstream of the stranding unit in the stranding direction and at which the strand material exits the stranding unit and is expediently supplied to a stranding nipple. Upstream of the stranding unit in the stranding direction, the stranding unit then accordingly has a rear side at which, for example, a centrally guided center core is supplied as a core for the stranded material.

In a preferred further development, the basket, preferably all baskets, is/are mounted in the cage to be rotatable around a respective basket longitudinal axis which extends parallel to the stranding axis. The reels mounted in the basket are, in particular, also rotatable around a reel axis here, which likewise extends parallel to the stranding axis and in particular also coaxially to the basket longitudinal axis. This longitudinal alignment of the different rotational axes results in a particularly optimal force effect on the individual components of the stranding unit during operation. In a particularly suitable manner, the centrifugal forces arising during operation act on any axes here, namely the basket longitudinal axis and the reel axis, only in the radial direction and not in the axial direction, i.e. along the respective axis. Therefore, during operation, the centrifugal forces which arise are distributed particularly evenly so that a load on the components is correspondingly even and deformation or even damage resulting from a variable load is prevented. A further advantage for a reel inserted into a basket is then furthermore created in that only radial forces act on the strand material wound thereon and a slipping of the strand material in the direction of the reel axis is thus prevented in a particularly simple manner. The reel, which has a reel core and a reel flange, is also likewise thus protected since the strand material does not slip back and forth on the reel core and the dynamic loads on the reel core and the reel flange are therefore in particular reduced.

For rotatably mounting the cage in the frame, different embodiments are essentially suitable, for example a bearing using ball bearings, plain bearings or magnetic bearings having correspondingly suitable balls or magnetic coils as frame bearing elements. In a particularly simple and suitable embodiment, however, the frame bearing elements each have a number of frame rollers for mounting the cage. These frame rollers are positioned in a fixed manner relative to the frame so that the cage therefore rolls over these frame rollers during operation. To this end, the cage preferably has, on its outer circumference, a corresponding cage running surface on which the frame rollers are seated. The cage running surface is expediently of a convex design here and is therefore also seated particularly securely in correspondingly concavely profiled frame rollers in the axial direction.

In a particularly preferred configuration, a frame bearing element contains two frame rollers which are combined by an articulated arm to form a rolling unit which is then fastened to the frame. A plurality of such rolling units are then fastened to the frame, distributed around the cage in the circumferential direction. The stranding unit preferably moreover contains at least two frames having corresponding frame bearing elements which are positioned at different longitudinal positions along the stranding axis. Such a frame then forms a cylindrical cage space extending along the stranding axis, in which the cage is rotatably arranged. The frame therefore encloses the cage in particular completely, at least in the radial direction.

To enable a particularly simple and precise alignment of the cage relative to the frame, the frame bearing elements are each suitably fastened to the frame by an eccentric pin. The frame bearing elements are thus displaceable in a radial plane perpendicularly to the stranding axis in a restricted manner so that possible manufacturing tolerances of the frame or the cage can be compensated in a simple manner when the cage is inserted into the frame. Through a corresponding adjustment of the frame bearing elements, it is then possible to achieve particularly smooth running of the cage and therefore particularly even forces during operation.

Since the dead weight of the cage, the baskets and the strand material arranged therein is not usually negligible, the frame has a closer arrangement of frame bearing elements in a lower region below the stranding axis than in an upper region. This will allow in particular for the downwardly acting weight forces, which are absorbed by the frame in an improved manner owing to the closer arrangement of frame bearing elements in this lower region. In the upper region of the frame, correspondingly fewer frame bearing elements are then arranged since only the centrifugal forces in effect during operation have to be absorbed.

To prevent torsional stresses in the finished stranded material, stranding regularly takes place with a so-called reverse rotation, i.e. the baskets are each rotated in the opposite direction of rotation to the cage so that the baskets do not twist relative to the frame but are only moved on the corresponding rotation circles. In a particularly preferred further development, in particular for realizing such a reverse rotation, the basket is also mounted on the cage by a number of cage bearing elements, in particular cage rollers, which are arranged around the basket in the circumferential direction. In other words: the individual baskets are also mounted around the outer circumference relative to the cage in the same way as the cage is also mounted around the outer circumference on the frame. In an advantageous manner, this results in a correspondingly even distribution of centrifugal forces during the rotation, in particular the reverse rotation, of the basket relative to the cage. This design is particularly advantageous with the above-described design having basket longitudinal axes which extend parallel to the stranding axis.

The cage bearing elements are expediently configured in the same manner as the frame bearing elements and preferably as rolling units which are then attached accordingly to the cage by an eccentric pin. In an analogous manner, a plurality of cage bearing elements are then formed as rolling units, each having in particular two cage rollers, on which the basket rolls during operation.

In particular for receiving the baskets, the cage expediently has a number of cage plates which are arranged perpendicularly to the stranding axis at different longitudinal positions along the stranding axis and each have an in particular circular basket opening into which the basket is inserted. The stranding unit preferably contains precisely as many cage plates as frames so that precisely one cage plate is associated with each frame, which cage plate is arranged in this frame so that in each case one cage plate and one frame extending around this are arranged at different longitudinal positions. In a particularly preferred embodiment of the stranding unit, two cage plates are arranged accordingly at two longitudinal positions, which cage plates are then surrounded by two frames. The baskets inserted into the cage then extend in particular at least over the clearance formed by the cage plates, preferably such that the reels in the baskets are arranged in this clearance, whereby an optimal force transmission in the radial direction takes place during operation. The cage plates act in combination with the cage and frame bearing elements, in particular as intermediary elements between the cage and the baskets, and thereby form in particular load-transmitting or force-transmitting elements.

During operation, owing to the rotation of the cage, a respective basket is acted upon by a centrifugal force which is directed outwards relative to the stranding axis. For particularly optimal absorption of this centrifugal force during operation, the cage bearing elements are therefore expediently arranged more closely next to one another in the outer region of the cage relative to the stranding axis than in an inner region. This additionally creates the advantage that correspondingly fewer cage bearing elements are arranged in the inner region so that the baskets can be, and also expediently are, placed altogether nearer to the stranding axis so that their rotation circle during operation is advantageously reduced.

The cage bearing elements can advantageously be set individually according to the prevailing force and installation-space requirements, i.e. the number of cage bearing elements actually acting on the cage is adjustable, in particular in a very simple manner owing to the attachment via eccentric pins. The above-described construction having an eccentric attachment of the cage bearing elements is moreover also self-centering in an advantageous manner. The same also applies analogously for the frame bearing elements.

A particularly optimal transmission of centrifugal forces is produced in an advantageous further development, in particular in that the frame bearing elements are arranged at particular longitudinal positions along the stranding axis and the cage bearing elements are arranged at substantially the same longitudinal positions. The cage bearing elements and the frame bearing elements are therefore arranged at the same height along the stranding axis, as it were. This is based on the consideration of realizing the shortest possible force flux paths. As a result, the forces transmitted from the basket to the cage in the radial direction are then passed directly to the frame in the radial direction during operation. A mechanical load in the axial direction, i.e. in the direction of the stranding axis, is thus reduced in a particularly efficient manner. In particular, bending moments which act on the frame are prevented particularly effectively. Such bending moments are, in particular, not only compensated here but prevented from the outset owing to the special arrangement. At a given longitudinal position, cage bearing elements and frame bearing elements are then arranged in succession in the radial direction. Here, substantially the same longitudinal position is understood to mean that there is an, at most, slight offset between cage bearing elements and frame bearing elements in the direction of the stranding axis, wherein an, at most, slight offset corresponds in particular to a width of the bearing elements. For example, cage bearing elements and frame bearing elements at a particular longitudinal position are arranged offset from one another at the most by the width of the frame bearing elements and/or cage bearing elements.

The cage, in particular its cage plates, preferably additionally have a number of strand lead-throughs for leading through a corresponding number of strands, which emerge for example from a further stranding unit connected upstream of the stranding unit or from a winder correspondingly connected upstream.

In a preferred design, the basket contains a tube which extends along the basket longitudinal axis and around this and into which a yoke is inserted. The yoke serves here in particular for receiving the reel which is then surrounded by the tube in the inserted state. The tube has in particular a closed lateral surface whereby, during operation, possibly unfavorable air vortices caused by a rotation of the basket are prevented. In particular, the tube does not serve for guiding the strand material but instead forms a stabilizing exoskeleton of the basket. Like the cage, the tube also has a front side and a rear side, wherein the strand material which is unreeled during operation exits via the front side. In a particularly light and robust configuration of the basket, the tube is preferably made from a carbon-fiber or glass-fiber reinforced plastics material, also known as CFRP or GFRP. For loading one of the baskets with a reel, the latter is firstly placed on the yoke and then inserted into the tube.

Externally, i.e. on its lateral surface, the tube expediently has a number of bearing tracks along which the cage bearing elements are guided. The bearing tracks therefore serve in particular for mounting the basket on the cage. This also ensures a particularly reliable retention in the direction of the basket longitudinal axis. For example, to this end, the bearing tracks are formed in particular as concave rolling tracks on the lateral surface of the tube and extend in particular completely around this so that cage rollers formed in a correspondingly complementary manner are guided along these rolling tracks. For a particularly reliable bearing, the tube then preferably contains two bearing tracks, which are arranged at different longitudinal positions in the direction of the basket longitudinal axis so that the basket as a whole is therefore mounted at two longitudinal positions in the cage.

In particular for securing and holding the yoke in the tube, the yoke preferably has at least one, but preferably two, bearing rings, each having a circumferential conical contact surface, which abut with form fit against inner conical yoke bearing surfaces of the tube in the inserted state of the yoke. The contact surfaces and yoke bearing surfaces therefore each form annular surfaces, which are set at a particular angle relative to the basket longitudinal axis in order to thus form part of a lateral cone surface. In the inserted state of the yoke in the basket, one contact surface and one yoke bearing surface then abut against one another in each case and thus realize a positioning of the yoke. The basket is then loaded with a reel, in particular such that the reel is placed on the yoke and the yoke is then inserted into the tube so that the contact surfaces and the yoke bearing surfaces abut against one another with form fit.

The bearing tracks are preferably arranged downstream of a respective contact surface, facing outwards from the basket longitudinal axis in the radial direction, i.e. in particular without an axial offset and at substantially the same longitudinal positions. In a similar manner to that already described above in conjunction with the cage bearing elements and the frame bearing elements, this results in a particularly optimal force flux in the radial direction through the contact surfaces and bearing surfaces arranged in direct succession in this direction. The forces absorbed by the yoke bearing surfaces are passed directly in the radial direction to the bearing tracks applied externally to the tube and, from there, likewise directly in the radial direction, to the cage bearing elements. An axial load on the tube is thus particularly efficiently prevented.

To enable the basket to be loaded or equipped particularly easily with strand material, the conical contact surfaces are expediently formed to extend towards the basket longitudinal axis in the same direction. The yoke is then preferably inserted into the tube at the end face, for example from the rear side of the stranding unit. In particular in combination with the basket longitudinal axis which is aligned in the direction of the stranding axis, this results in a particularly straightforward loading of the baskets with strand material. The yoke is preferably secured in the tube in the axial direction by a clamping lever, which is then arranged for example on the rear side of the basket and is used to reversibly clamp the yoke in the tube. As a result of the easy accessibility from the rear side, changing a reel only requires the clamping lever to be released, the yoke to be removed from the tube and the reel to be replaced accordingly.

To receive the reel, the yoke preferably has a reel holder, which is also located in a region between the two contact surfaces for positioning the reel within the tube. As a result of this arrangement of the reel between the contact surfaces, centrifugal forces which arise during the unwinding of the reel are transmitted to the yoke bearing surfaces via the contact surfaces in a considerably improved manner. The contact surfaces are therefore arranged in edge regions and at the end face of a reel placed on the yoke.

To clamp the reel, the reel holder expediently has two conical clamping chucks, wherein only one of the clamping chucks is displaceable relative to the yoke and along the basket longitudinal axis. The reel is then clamped and secured axially in the yoke by the clamping chucks. The conical clamping chucks engage here in correspondingly suitable openings in the end faces of the reel. The reel can then be clamped through a displacement of the displaceable clamping chuck. The displaceable clamping chuck here is rotatable for example via a thread, in particular a fine thread, and displaceable along the basket longitudinal axis. The displaceable clamping chuck is expediently accessible in a particularly easy manner via the end face of the basket, in particular on the rear side of the stranding unit. The other clamping chuck, on the other hand, advantageously does not need to be accessible; the locking of the reel expediently takes place simply by means of the displaceable clamping chuck.

To realize a reel change in a particularly simple manner, at least one pull-out rail, preferably two pull-out rails, is/are arranged on the tube, which enable the yoke to be reversibly pulled in and out of the tube and in the direction of the basket longitudinal axis. The yoke can then be pulled out of the tube in particular to the rear, i.e. on the rear side, and a reel placed on the yoke can then be correspondingly easily replaced. A complex dismantling of the yoke and separation from the cage is advantageously unnecessary here. Instead, changing the reel firstly involves releasing the clamping lever, then pulling the yoke out of the tube and finally releasing the reel holder and replacing the reel.

Owing to the longitudinal alignment of the reel, it is, in particular, not possible for the strand material to be unreeled directly in the stranding direction during operation. The basket therefore preferably has a deflection mechanism for the strand material unreeled from the reel, which moreover deflects the strand material, with no counter-bending, in the direction of an end face of the basket, in particular in the direction of the front side of the stranding unit. During the deflection, the strand material is necessarily bent in one or more directions, for example during the deflection by a deflection roller, wherein the mechanical load on the strand material is, however, reduced in an advantageous manner in that a bending-back, i.e. a counter-bending, does not take place, i.e. the deflection does not involve counter-bending. The deflection mechanism therefore contains a number of deflection elements, for example deflection rollers, by which the strand material is guided and deflected, but, while a deflection takes place in a particular deflection direction around a particular deflection axis, a further deflection in an opposite direction does not take place in the deflection mechanism as a whole. In other words: the strand material is not bent in two mutually anti-parallel directions in the deflection mechanism as a whole.

To compensate a longitudinal adjustment in a particularly simple manner when the strand material is unreeled, the deflection mechanism suitably contains a dancer guide having a dancer which is displaceable in the stranding direction. To this end, the dancer contains an adjusting element by which at least one of the deflection elements is displaceable in the stranding direction and whereby a difference in the travel distance for the strand material running through the deflection mechanism can be adjusted.

A pneumatic cylinder is essentially suitable as an adjusting element of such a dancer position control, which pneumatic cylinder has a particularly easily adjustable piston pressure force which is substantially constant over the entire adjusting region of the adjusting element. Owing to the high rotational speed of the basket during operation, it is however difficult to supply such an adjusting element with compressed air. In a suitable alternative, the adjusting element is therefore formed as a magnetic spring, as a linear motor or as a replaceable compression spring assembly. The longitudinal fluctuations which can be expected during the unreeling of the strand material are advantageously so small that an adjusting element which does not have a constant tensile force over the adjusting region can still be used, and still is used, with adequate precision.

In particular for realizing the above-mentioned reverse rotation, in a preferred further development the basket is coupled to the cage by a coupling mechanism for the purpose of reverse-rotating the basket during a rotation of the cage. The coupling mechanism here has a coupling which in turn has two wheels, namely a frame wheel rolling on the frame and a basket wheel driving the basket. The two wheels here are connected to one another in a fixed manner via an intermediate shaft. The rotation of the cage relative to the frame is thus translated into a rotation of the basket within the cage, in particular with a fixed translation ratio. The intermediate shaft here is guided in particular parallel to the stranding direction and preferably through a wall of the cage and mounted on this. In particular in combination with the design of the cage using a number of cage plates, the intermediate shaft is guided through a respective cage plate and also mounted on this; it is therefore rotated around the stranding axis together with the cage during operation. The coupling then contains two wheels connected to one another in a rotationally fixed manner, wherein the one wheel is in active communication with the fixed frame as a frame wheel and the cage wheel is in active communication with the basket.

To completely prevent a relative rotation of the basket, i.e. to realize an optimal reverse rotation, a rotation of the basket takes place with a translation ratio of one. To this end, the two wheels are correspondingly suitably dimensioned with respect to one another in terms of their diameters and the ratios of the diameters.

In a particularly cost-effective and robust design, the frame wheel is formed as a chain wheel and runs on a chain which is fastened to the frame. The chain here is attached in particular internally on the frame, for example via flange plates. By using a chain, it is moreover possible to dispense with a toothed profile on the frame, which would possibly be particularly large depending on requirements. Since the chain here is moreover used as a static component, it is also not subject to the usual restrictions during operation, for example in terms of centrifugal forces or maximum rotational speeds. The chain is preferably a particularly cost-effective pin chain.

The attachment of the coupling to the basket expediently takes place at its outer side, i.e. on the lateral surface of the tube. The basket wheel is then preferably formed as a pulley and drives a belt which extends around the basket and acts on a toothed contour applied externally to the basket. The toothed contour is expediently already formed on the tube during the manufacture of the latter, i.e. it is produced in one piece with the tube. The size ratio of the basket wheel to the frame wheel is then selected accordingly, taking into account the diameter of the basket and the diameter of the cage, so as to produce a preferably vanishing relative rotational movement of the cage relative to the frame, i.e. a translation ratio of one.

When the strand material exits the stranding unit at the front side, the strand material is subjected to corresponding centrifugal forces owing to the rotational movement. In a preferred further development, these centrifugal forces are absorbed in that the stranding unit has at least one guide element for guiding the strand material to the stranding nipple. The guide element here is arranged downstream of the cage in the stranding direction, i.e. on its the front side, and expediently moves with the unreeled strand material during operation in order to achieve the least possible relative movement of the strand material against the guide element. To minimize residual friction forces and accordingly to reduce wear on the strand material to the greatest extent possible as it is guided along the guide element, the guide element has a guide surface which is manufactured from a type of material which generates as little friction as possible when in contact with the material of the strand material. The guide element here is in particular a preferably co-moving supporting element and serves primarily for preventing damage to the strand material caused by its dead weight under a centrifugal load. Therefore, the guide element is specifically not a pre-stranding plate.

The basket has a tube which extends along a basket longitudinal axis and around this and into which a yoke is inserted for receiving a reel with strand material wound thereon. A deflection mechanism for the strand material is arranged at the end face for unreeling the strand material in the lateral direction relative to the reel. As a result of arranging the deflection mechanism at the end face, the basket adds particularly little to the dimensions in the radial direction, whereby the rotation circle of the basket during operation can be reduced considerably and the stranding unit equipped with a corresponding basket can be operated at a considerably higher rotational speed.

The yoke is inserted into the tube in particular at the end face, in particular at that end face of the tube which is opposite the deflection mechanism. The reel is thus accessible and replaceable in a particularly simple manner via the corresponding end face. The yoke can preferably be pulled out of the tube at the rear side for removing or inserting the reel and the deflection mechanism is arranged at the front side so that the strand material is unreeled at the front side during operation and the deflection mechanism is not in the way when the reel is changed. The deflection mechanism is expediently part of the yoke and can therefore be pulled out of the tube together with this, whereby a threading of the strand material into the deflection mechanism during the insertion of a reel is made considerably easier.

Other features which are considered as characteristic for the invention are set forth in the appended claims.

Although the invention is illustrated and described herein as embodied in a stranding unit for a stranding machine and a basket for a stranding unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
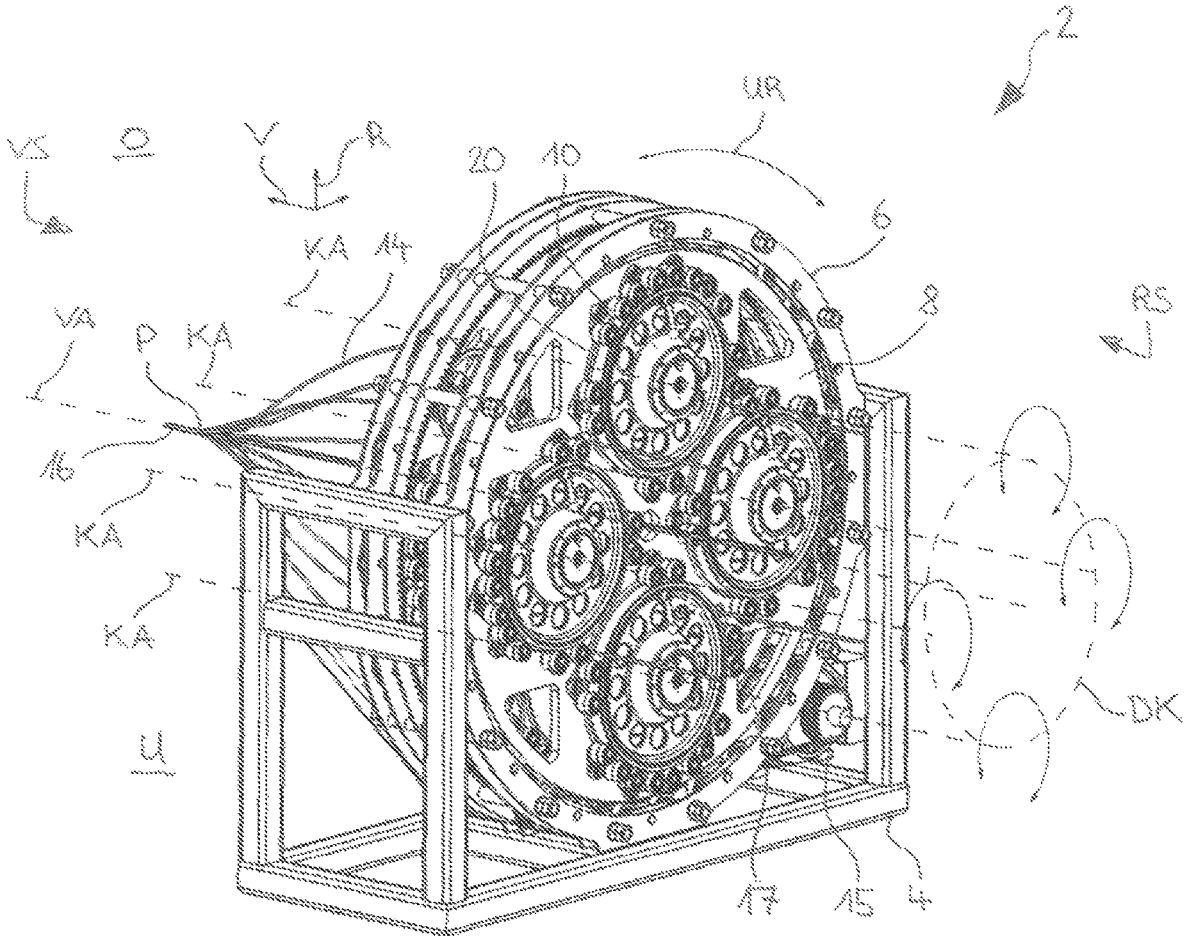
FIGS. 1A-1D are diagrammatic, perspective and side views of a stranding unit for a stranding machine in different views.
Figure 1B:
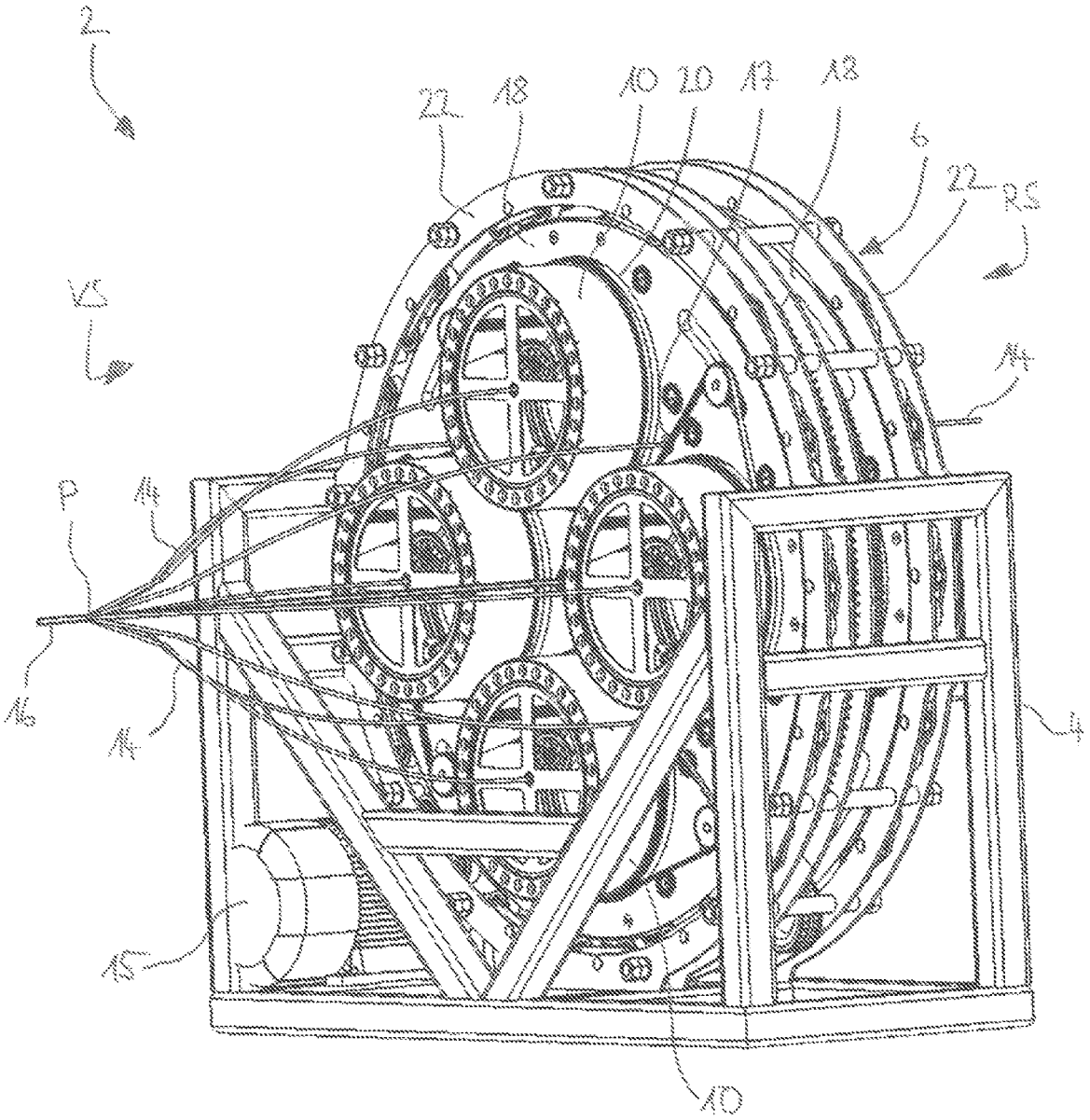

Referring now to the figures of the drawings in detail and first, particularly to FIGS. 1A-1B thereof, there is shown a stranding machine 2 in different views. FIG. 1A here shows the stranding machine 2 in a perspective rear view, FIG. 1B in a perspective front view, FIG. 1C in a side view and FIG. 1D in turn in a perspective rear view and in an extended state. The stranding machine 2 contains a stand 4 to which a frame 6 is fastened, in which a cage 8 is rotatably mounted. A number of baskets 10 (four baskets here) are in turn arranged in the cage 8, which baskets 10 are mounted to be rotatable relative to the cage 8. The baskets 10 serve here for receiving reels 12 having strand material 14 wound thereon. The stranding unit 2, and more precisely the cage 8, is driven by a drive motor 15 arranged outside and to the side of the frame.

During operation, the strand material 14 is unreeled from the reels 12 by the stranding unit 2 and supplied in a stranding direction V to a stranding point P at which the strands 14 are stranded to form a stranded material 16. To this end, a stranding nipple (not illustrated in more detail here) is arranged in particular at the stranding point P. In addition, the stranding unit 2 shown here has a number of strand lead-throughs 17 for leading through strands 14 which are unreeled upstream of the stranding unit 2, e.g. from a further stranding unit 2 connected upstream. One of the strand lead-throughs 17 is guided centrally along the stranding axis VA and serves here in particular for supplying a strand 14 as a center core, which is provided for example from an unwinder (not shown here) which is connected upstream.

During the stranding of the strands 14, a rotation of the cage 8 takes place in a circumferential direction UR around a stranding axis VA which extends in the stranding direction V. Through a rotation of the cage 8, the baskets 10 are moved on a rotation circle DK around the stranding axis VA. In the exemplary embodiment shown here, the stranding additionally takes place with a so-called reverse rotation wherein, in addition to the rotation of the baskets 10 around the stranding axis VA, each of the baskets 10 is additionally each rotated around its own basket longitudinal axis KA in each case. The rotation of a respective basket 10 around its basket longitudinal axis KA takes place in particular in the opposite direction to the direction of rotation of the cage 8 in the frame 6.

All in all, during operation of the stranding unit 2, three different rotational movements are therefore executed here, namely first the unreeling of the strand material 14 from a respective reel 12, second the rotation of a respective basket 10 around its basket longitudinal axis KA and thirdly the movement of the baskets 10, in particular their basket longitudinal axes KA, on a rotation circle DK around the stranding axis VA. In the preferred embodiment described here, all of the rotational axes here are aligned parallel to one another. In particular, the reels 12 each have a reel axis which corresponds to a respective basket longitudinal axis KA. The basket longitudinal axes KA then extend in the stranding direction V and parallel to the stranding axis VA. Owing to this arrangement, the centrifugal forces generated during the rotation act only as radial forces on the individual components of the stranding machine and not as axial forces.

Figure 1C:
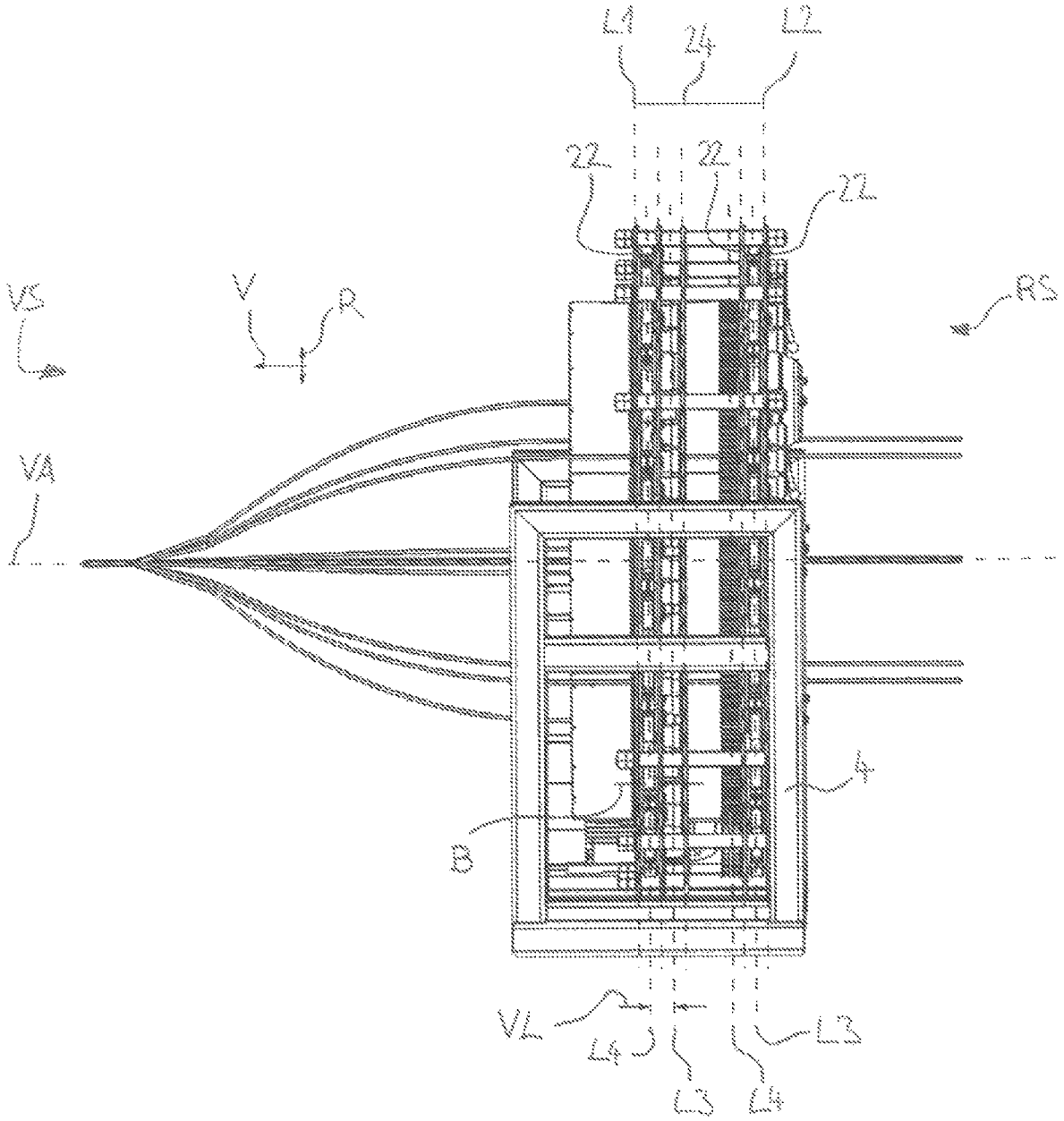
Figure 1D:
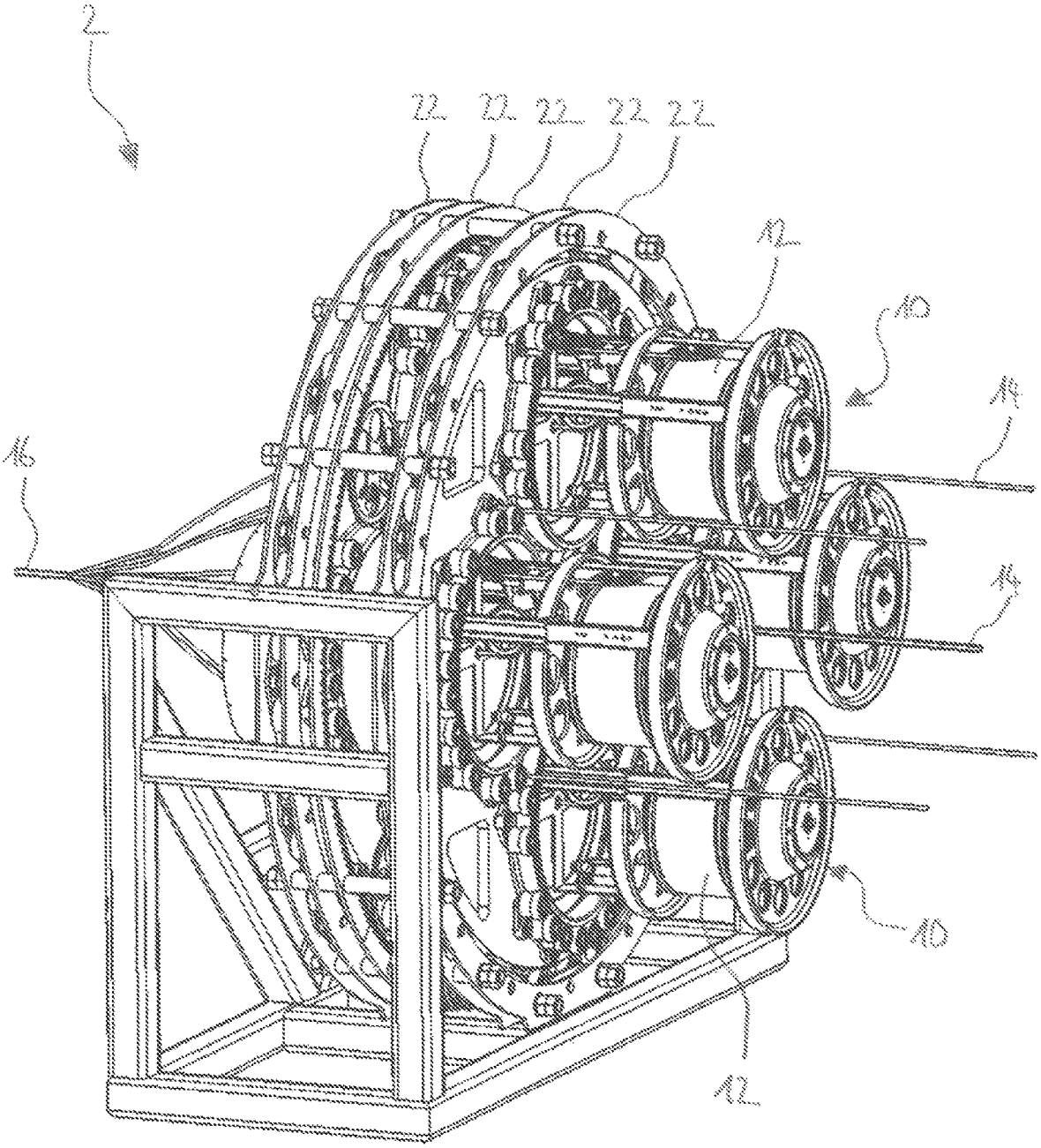

The cage 8 contains a plurality of cage plates 18, which can be seen particularly clearly in FIG. 1C. The cage plates 18 each have basket openings 20 into which the baskets 10 are inserted. The cage 8 formed in this way is surrounded by the frame 6 completely in the circumferential direction UR, which frame is formed by a number of rings 22 in the exemplary embodiment shown. These rings 22 are constructed in particular as steel rings here, which are fastened to the stand 4 and are arranged at different longitudinal positions L1, L2 along the stranding axis VA and thus enclose a clearance 24 in which the cage 8 is arranged. The baskets 10 are then inserted into the cage 8 in such a way that the reels 12 are arranged in the clearance 24 between the two outermost longitudinal positions L1, L2.

Figure 2:
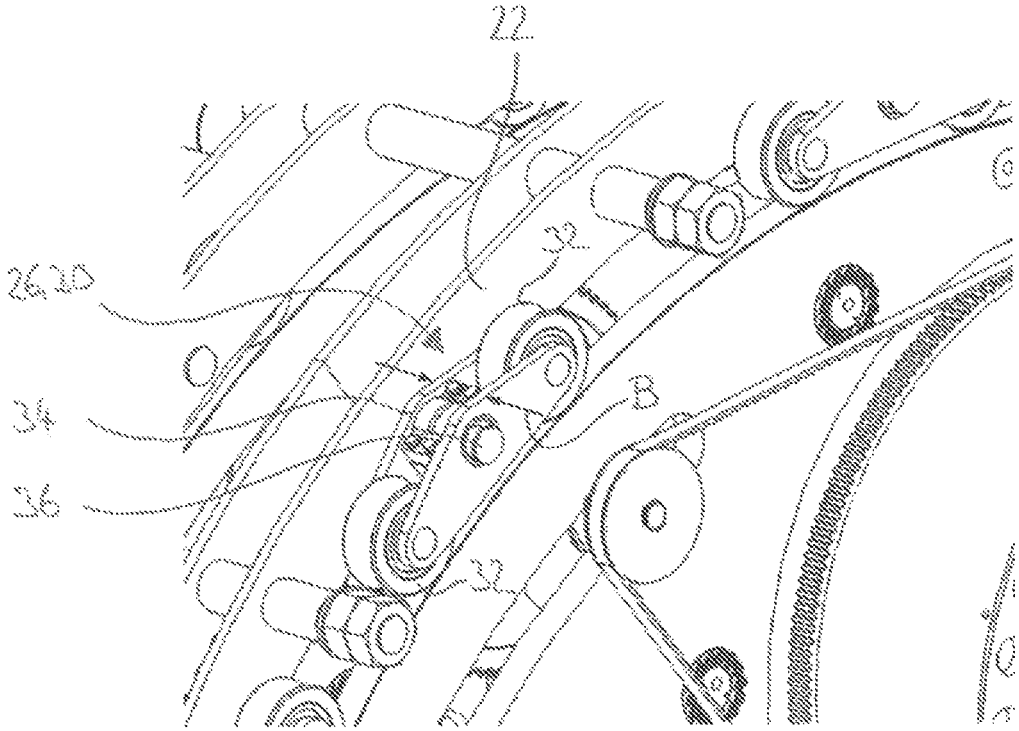
FIG. 2 is a detailed perspective view of a circumferential bearing of the stranding machine.
Figure 3:
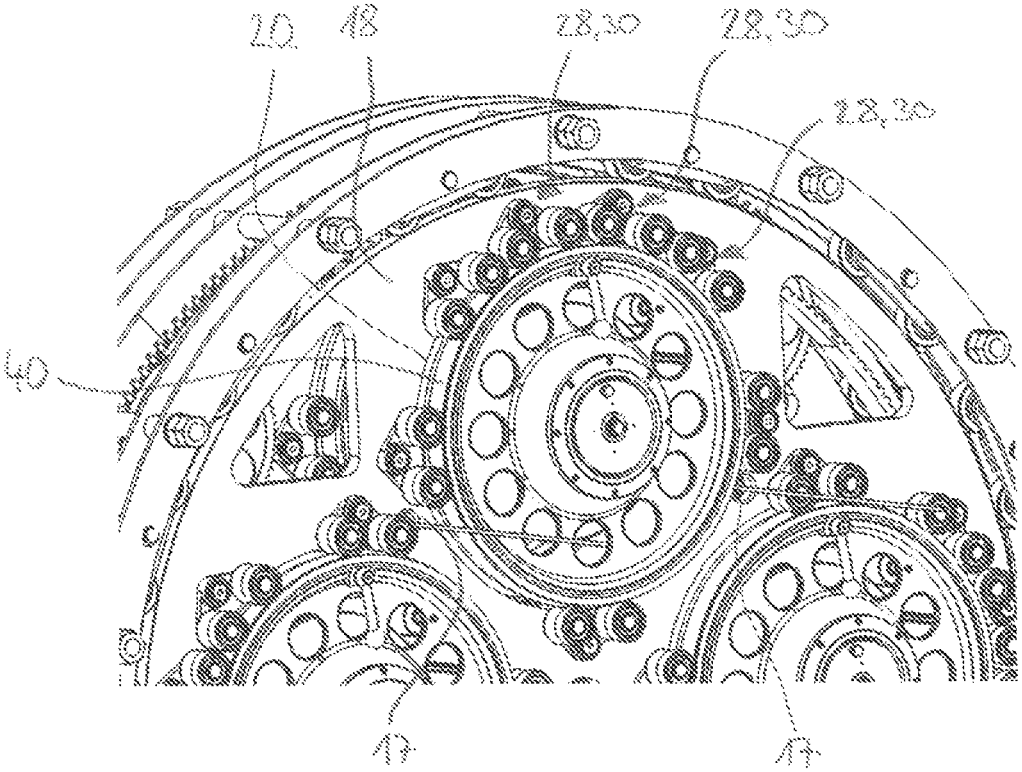
FIG. 3 is a detailed perspective view of the stranding machine and a basket in a rear view.

In the embodiment shown here, the bearing of the cage 8 in the frame 6 and the basket 10 in the cage 8 takes place by a number of frame bearing elements 26 and cage bearing elements 28 respectively. These can be seen particularly clearly in FIG. 2 and FIG. 3 respectively. The frame bearing elements 26 and the cage bearing elements 28 are advantageously formed in the same manner here, namely as rolling units 30, which each have a number of rollers 32 (two rollers here) which are fastened to the frame 6 and the cage 8 respectively on an articulated arm 34 and via eccentric pins 36. The rollers 32 here each have a concave running surface which rolls on a correspondingly convex counter surface during operation. To this end, correspondingly convexly formed cage running surfaces 38 are formed in particular on the outer circumference of the cage plates 18, while the baskets 10 each have a number of convex bearing tracks 40 around the circumference.

As can be seen particularly clearly in FIG. 1C, the baskets 10 are mounted at a number of longitudinal positions L3 by the cage bearing elements 28 and the cage 8 is mounted on the frame 6 at a number of longitudinal positions L4, which correspond substantially to the longitudinal positions L3. A respective longitudinal position L3 here only has a small offset VL relative to a respective longitudinal position L4, which corresponds here to a width B of the bearing elements 26, 28, i.e. in particular approximately a width of the rollers 32. Through this positioning of the bearing elements 26, 28 in succession in the radial direction R, an optimal force flux in the radial direction R is ensured during operation of the stranding unit 2 and a load in the axial direction, i.e. in the stranding direction V, is particularly greatly reduced.

To additionally absorb weight forces in an optimal manner, the frame bearing elements 26 are arranged closer together in a lower region U of the stranding unit 2 than in an upper region O. This can be seen in particular in FIG. 1A. In a similar manner, for particularly optimal absorption of the outwardly acting centrifugal forces, the basket bearing elements 28 are arranged closer together towards the outside in the radial direction R than towards the stranding axis VA. This can also be seen particularly clearly in FIG. 1A, but also in FIG. 3. Through the reduced use of cage bearing elements 28 near to the stranding axis VA, it is moreover possible to arrange the baskets 10 particularly closely together towards the stranding axis VA and thus to reduce the radius of the rotation circle DK and therefore to also advantageously reduce the centrifugal forces produced during operation.

Figure 4:
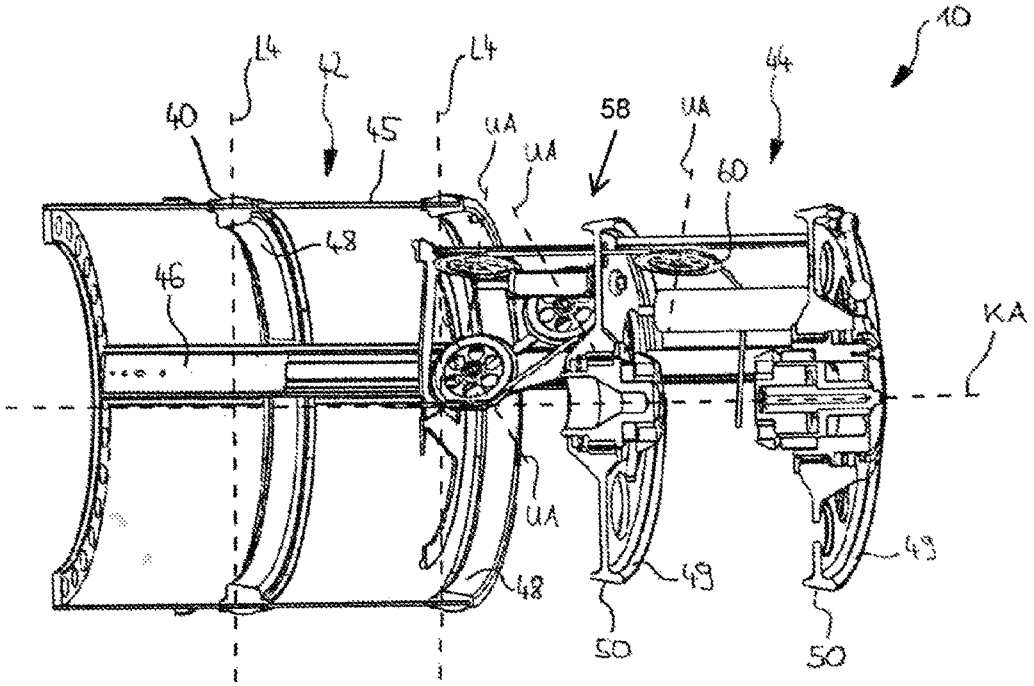
FIG. 4 is a perspective and sectional view having a pulled-out yoke.
Figure 5:
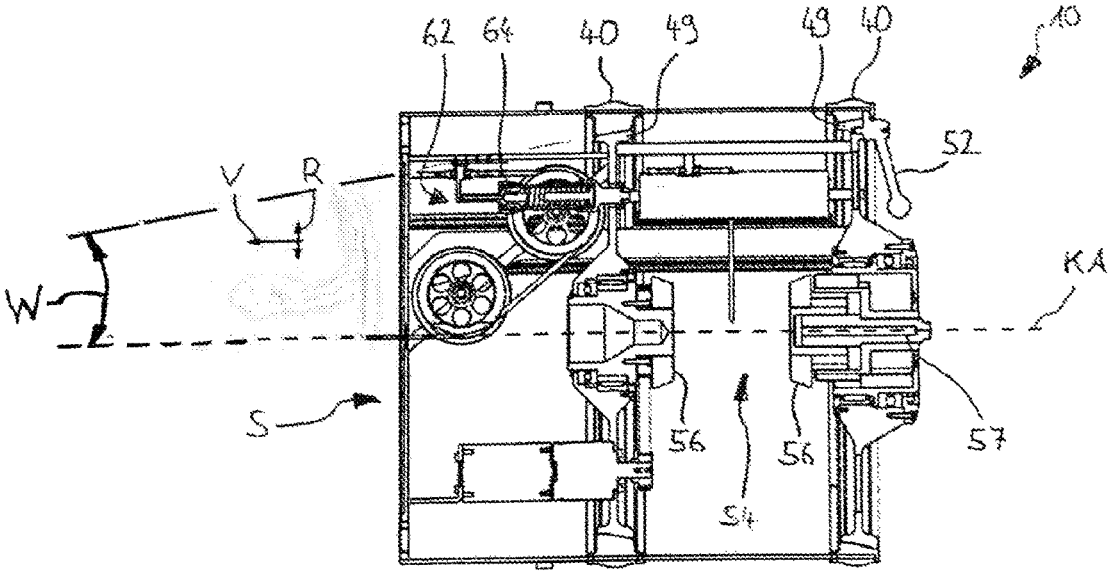
FIG. 5 is a sectional view of the yoke.

FIG. 4 shows a perspective sectional view of a basket 10 which has a tube 42 into which a yoke 44 is inserted for receiving a reel 12 (not illustrated here). The tube 42 extends along the basket longitudinal axis KA and contains a number of pull-out rails 46, via which the yoke 44 can be slid into and pulled out of the tube 42 in the direction of the basket longitudinal axis KA. This sliding in and out takes place in particular at the rear side of the tube 42, i.e. on the rear side RS of the stranding unit 2. In FIG. 5, the tube 42 is illustrated with the yoke 44 in the slid-in state.

The bearing tracks 40 arranged on a lateral surface 45, i.e. on the outer circumference of the tube 42, for the basket 10 to roll on the cage bearing elements 28 are clearly shown in FIG. 4. The cross-sectionally convex design is likewise clearly shown. Starting from the basket longitudinal axis KA and in a radial direction R towards the outside, conical yoke bearing surfaces 48 in each case are formed internally on the tube 42, upstream of the bearing tracks 40, for the form-fitting bearing of the yoke 44. To this end, the yoke 44 has a corresponding number of bearing rings 49 having outwardly facing conical contact surfaces 50. The form-fitting arrangement can be clearly seen in particular in FIG. 5. The contact surfaces 48, 50 here are set at an angle W so that they are formed correspondingly conically and enable an optimal form fit. In particular, the contact surfaces 48, 50 are set in the same direction towards the basket longitudinal axis KA so that rearward insertion is possible. To prevent the yoke 44 from falling out unintentionally during operation, a clamping lever 52 is provided to lock the yoke, by which the yoke 44 is clamped in the tube 42.

To receive a reel 14, the yoke 44 contains a reel receiving device 54 which has two conical clamping chucks 56, which are spaced in the direction of the basket longitudinal axis KA here and between which the reel 14 is then clamped. The reel receiving device 54 is arranged between the contact surfaces 50 here such that an inserted reel 14 is positioned between them and therefore any centrifugal forces acting radially relative to the reel 14 are transmitted via the contact surfaces 48, 50 in an optimal manner, firstly via the cage bearing elements 28 to the cage 8 and, finally, from there, via the frame bearing elements 26, to the frame 6. Any axial forces, i.e. forces in the direction of the basket longitudinal axis KA and the stranding axis V, are reduced to a minimum here. The clamping chuck 56 on the rear side can moreover be moved along the basket longitudinal axis by means of a thread 57 in order to clamp a reel 14 particularly securely. As a result of arranging this adjustable clamping chuck 56 on the rear side, it is moreover particularly easily accessible from the rear side RS of the stranding unit 2.

During operation, the strand material 14 is unreeled from a respective reel 12 in the radial direction R and then deflected in the stranding direction V via a deflection mechanism 58 and conveyed out of the basket 10 at the front side, i.e. via an end face S of the tube 42. To this end, the deflection mechanism 58 contains a number of deflection elements 60 which are formed here as rollers. The deflection of the strand 14 takes place here by the deflection mechanism 58, with no counter-bending, in order to prevent too great a mechanical load on the strand material 14. In other words: the deflection elements 60 each have a deflection axis UA around which the strand material 14 is deflected in each case, wherein, in the deflection mechanism 58 as a whole, a deflection in different directions around respective deflection axes UA having the same direction does not take place. The deflection mechanism 58 additionally contains a dancer guide 62 having an adjusting element 64 to ensure longitudinal compensation of the possibly unevenly unreeled strand material 14 during operation. The adjusting element 64 here is formed in particular such that a longitudinal compensation takes place in the direction of the basket longitudinal axis KA.

Figure 6A:
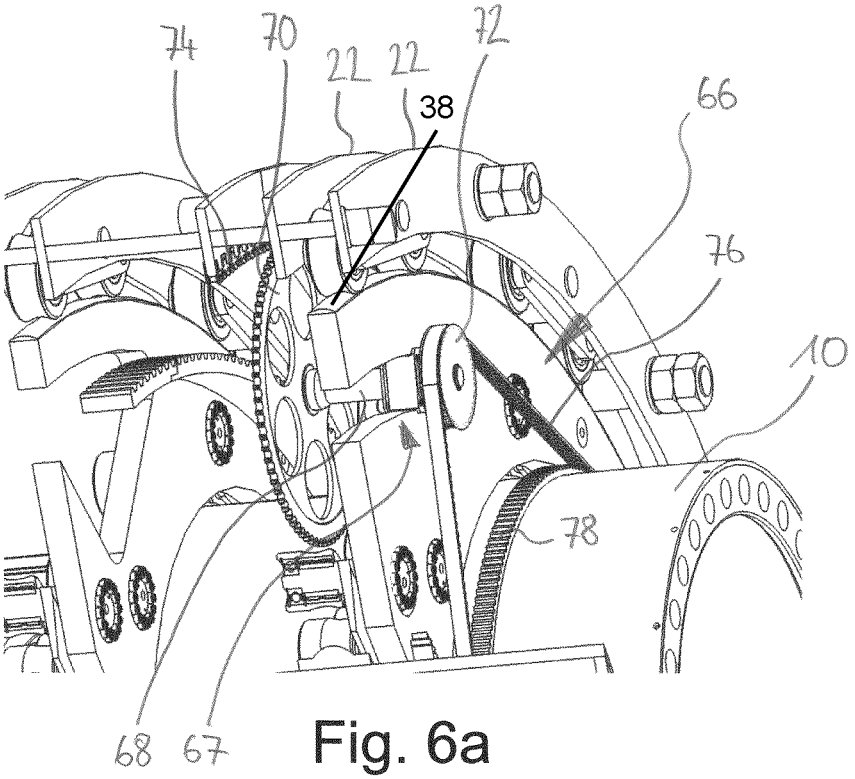
FIGS. 6A-6C are perspective and detailed diverse views of a coupling mechanism of the stranding machine.
Figure 6B:
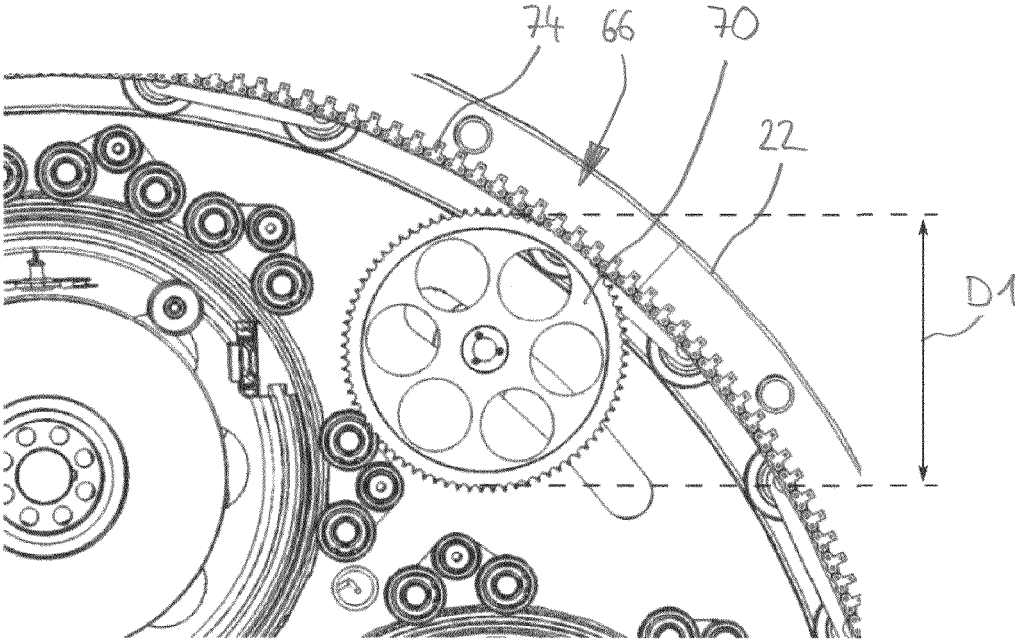
Figure 6C:
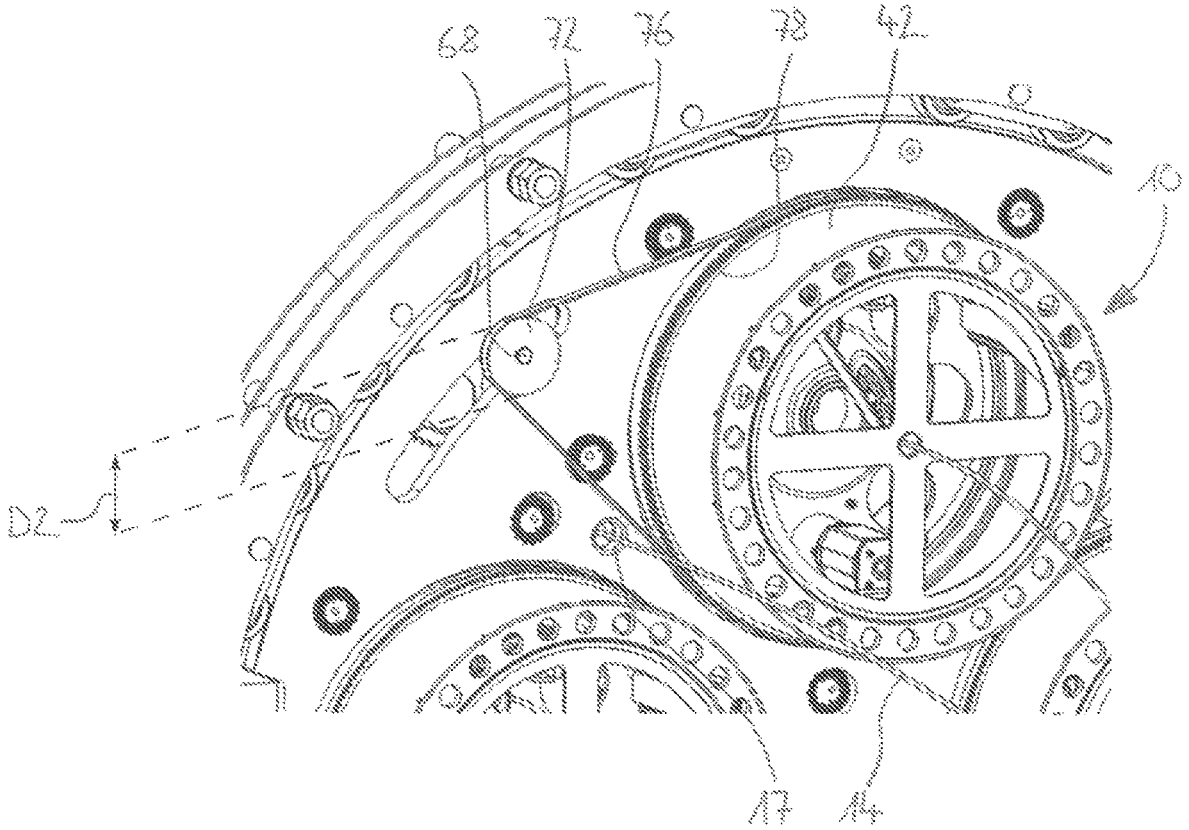

To realize an additional rotation of the basket 10 and in particular a reverse rotation as described at the outset, the stranding unit 2 has a coupling mechanism 66 between the frame 6 and the baskets 10, which can be clearly seen in FIGS. 6A-6C. By means of this coupling mechanism 66, the rotation of the cage 8 relative to the frame 6 is translated into a rotation of the basket 10 relative to the cage 8. To this end, the coupling mechanism 66 has, for each of the baskets 10 here, a coupling 67 having an intermediate shaft 68 which is mounted on the cage 8, more precisely on one of the cage plates 18, and to which two wheels 70, 72 are attached, namely a frame wheel 70 and a basket wheel 72. These wheels 70, 72 are connected to the intermediate shaft 68 in a rotationally fixed manner to produce a fixed translation ratio.

During operation the basket wheel 70 rolls on the frame 6—in the embodiment shown here, on a chain 74 which is fastened to one of the rings 22 of the frame 6. The basket wheel 72 then drives one of the baskets 10 via a belt 76. To this end, a toothed contour 78 is formed externally on the lateral surface 45 of the associated tube 42. The translation ratio of the coupling 67 is produced, amongst other things, by the ratio of the diameter D1, D2 of the wheels 70, 72. In the exemplary embodiment shown here, the ratio is selected such that the translation ratio is one and therefore a reverse rotation of the basket 10 is produced such that a respective basket 10 is only moved on the rotation circle DK relative to the stand 4 of the stranding unit 2 but is itself not rotated relative to the stand 4.

The invention claimed is:

1. A stranding unit for a stranding machine, comprising:
a stranding axis;
at least one basket;
a cage in which said at least one basket is disposed for receiving a reel having strand material wound thereon, said basket mounted in said cage for being rotatable around a basket longitudinal axis extending parallel to the stranding axis, and the reel mounted in said basket being rotatable around a reel axis extending parallel to the stranding axis and the basket longitudinal axis;
a plurality of frame bearing elements; and
a stand having a frame disposed to extend in a circumferential direction around the stranding axis and around said cage, said cage mounted on said frame by said plurality of frame bearing elements and being rotatable around the stranding axis.

2. The stranding unit according to claim 1, wherein said reel axis extends coaxially to the basket longitudinal axis.

3. The stranding unit according to claim 1, wherein said frame bearing elements each have a plurality of frame rollers for mounting said cage.

4. A stranding unit for a stranding machine, comprising:
a stranding axis;

at least one basket;

a cage in which said at least one basket is disposed for receiving a reel having strand material wound thereon;

a plurality of frame bearing elements;

a stand having a frame disposed to extend in a circumferential direction around the stranding axis and around said cage, said cage mounted on said frame by said plurality of frame bearing elements and being rotatable around the stranding axis; and eccentric pins, said frame bearing elements are each fastened to said frame by one of said eccentric pins.

5. The stranding unit according to claim 1, wherein said frame has a lower region being below the stranding axis where said frame bearing elements are disposed more closely together than in an upper region for a purpose of absorbing weight forces.

6. The stranding unit according to claim 1, further comprising cage bearing elements, said basket is mounted on said cage by said plurality of cage bearing elements which are disposed around said basket in the circumferential direction, said cage bearing elements are disposed more closely next to one another in an outer region relative to the stranding axis of said cage than in an inner region for a purpose of absorbing centrifugal forces during operation.

7. The stranding unit according to claim 1, further comprising cage bearing elements, said basket is mounted on said cage by said plurality of cage bearing elements which are disposed around said basket in the circumferential direction; and said frame bearing elements are disposed at particular longitudinal positions along the stranding axis and said cage bearing elements are disposed at substantially same longitudinal positions.

8. The stranding unit according to claim 1, wherein:

said basket has a tube which extends along a basket longitudinal axis and around the basket longitudinal axis; and said basket has a yoke inserted into said tube for receiving the reel.

9. The stranding unit according to claim 8, wherein:

said tube has inner conical yoke bearing surfaces; and said yoke has at least two bearing rings, each of said bearing rings having a circumferential, conical contact surface, which abut with form fit against said inner conical yoke bearing surfaces of said tube in an inserted state.

10. The stranding unit according to claim 9, wherein said yoke has a reel holder for receiving the reel and for positioning the reel within said tube in a region between two of said circumferential, conical contact surfaces.

11. The stranding unit according to claimed claim 10, wherein:

said reel holder has two conical clamping chucks for clamping the reel; and only one of said conical clamping chucks is displaceable relative to said yoke and along the basket longitudinal axis.

12. The stranding unit according to claim 9, further comprising a plurality of cage bearing elements disposed around said basket in the circumferential direction, said basket is mounted on said cage by means of said plurality of cage bearing elements;

wherein said tube has, on an outside, a plurality of bearing tracks along which said cage bearing elements are guided for mounting said basket on said cage; and said bearing tracks are disposed downstream of a respective said circumferential, conical contact surface, facing outwards from the basket longitudinal axis in a radial direction.

13. The stranding unit according to claim 8, further comprising at least one pull-out rail disposed on said tube for reversibly pulling said yoke in and out of said tube and in a direction of the basket longitudinal axis.

14. The stranding unit according to claim 1, wherein:

said tube has an end face; and said basket has a deflection mechanism for the strand material unreeled from the reel, which deflects the strand material, with no counter-bending, in a direction of said end face.

15. A stranding unit for a stranding machine, comprising:

a stranding axis;

at least one basket;

a cage in which said at least one basket is disposed for receiving a reel having strand material wound thereon said cage having a plurality of cage plates disposed perpendicularly to the stranding axis and each of said cage plates having a basket opening formed therein into which said basket is inserted;

a plurality of frame bearing elements; and a stand having a frame disposed to extend in a circumferential direction around the stranding axis and around said cage, said cage mounted on said frame by said plurality of frame bearing elements and being rotatable around the stranding axis.

16. The stranding unit according to claim 1, further comprising:

a coupling mechanism for coupling said basket to said cage for a purpose of reverse-rotating said basket during a rotation of said cage;

an intermediate shaft; and a coupling having two wheels including a frame wheel rolling on said frame and a basket wheel driving said basket, wherein said two wheels are connected to one another in a fixed manner via said intermediate shaft.

17. The stranding unit according to claim 16, further comprising a chain fastened to said frame, said frame wheel is formed as a chain wheel and runs on said chain.

18. The stranding unit according to claim 1, further comprising at least one guide element for guiding the strand material to a stranding nipple.

* * * * *